United States Patent [19]

Weber-Henning et al.

[11] 4,448,442

[45] May 15, 1984

[54] LONGITUDINALLY ADJUSTABLE SKI POLE

[76] Inventors: Hans Weber-Henning, Dorfhalde 14, Stäfa, 8712; Peter Weber, Haltenstrasse 146, Meilen, 8706, both of Switzerland

[21] Appl. No.: 336,610

[22] Filed: Jan. 4, 1982

[30] Foreign Application Priority Data

Jan. 8, 1981 [CH] Switzerland ..... 9681

[51] Int. Cl.[3] ..... A63C 11/22

[52] U.S. Cl. ..... 280/823; 135/75

[58] Field of Search ..... 280/821, 822, 823; 403/106, 107, 109, 328, 329, 324, 325; 135/69, 75, 76, 82

[56] References Cited

U.S. PATENT DOCUMENTS

| | | | |
|---|---|---|---|
| 619,235 | 2/1899 | Schwarting | 135/82 |
| 2,512,985 | 6/1950 | Tveten | 280/823 |
| 2,719,688 | 10/1955 | Seifert | 403/106 |
| 3,960,382 | 6/1976 | Reynolds | 280/823 |
| 4,244,602 | 1/1981 | Allsop | 280/821 |

*Primary Examiner*—Joseph F. Peters, Jr.
*Assistant Examiner*—Timothy Roesch
*Attorney, Agent, or Firm*—Warren B. Kice

[57] ABSTRACT

An improved ski pole having an adjustable length is provided with two telescopically movable tube sections. The tube sections are inserted into each other and are movable relative to each other and are provided with a latch and a plurality of catches. When shortening the length of the ski pole, a spring is tensioned. The increasing of the length of the ski pole is caused by the tensioned spring. The switch is arranged at the reverse side of the grip of the ski pole. The latch is arranged fixedly at the inner tube section and the catches are arranged at a pivotable cylinder which can be elevated and lowered as well as rotated. The catches are defined by horizontally extending sections of at least one Z-shaped groove. The pivoting cylinder is connected at a off-center pivot point to the switching or operating, respectively, member. The entire mechanism for the longitudinal adjustment of the ski pole is arranged in the gripping section of the ski pole. This gripping section is easily mounted onto normal ski poles. The ski pole is specifically intended for cross-country skiers, who can adjust the ski pole to have three varying lengths depending upon the prevailing country shape whereby a chosen length is arrested by an interlocking of the tube sections which can be moved in each other. The pivoting cylinder may additionally comprise an axially extending additional coulisse. If the pivoting cylinder is rotated by the operating member such that the additional groove is aligned with the latch, the ski pole is in a condition in which it elastically yields in its longitudinal direction.

13 Claims, 7 Drawing Figures

Fig. 1
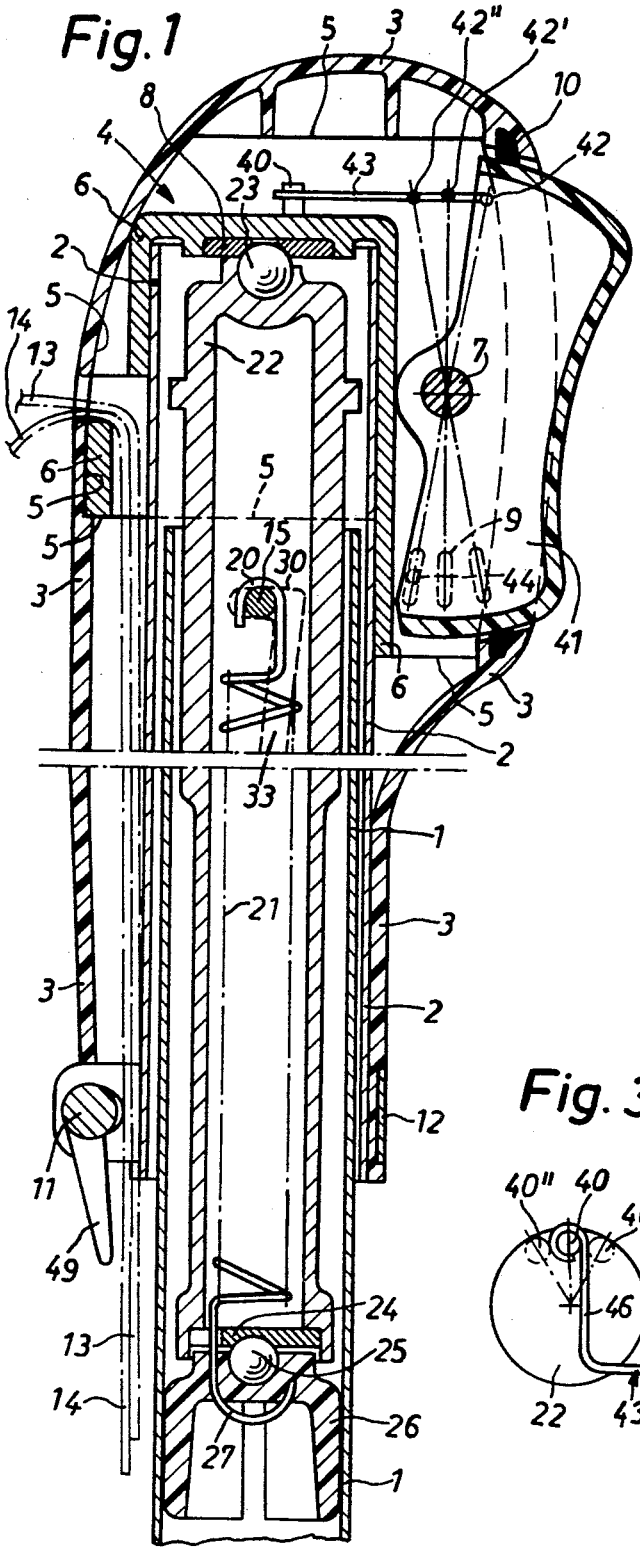
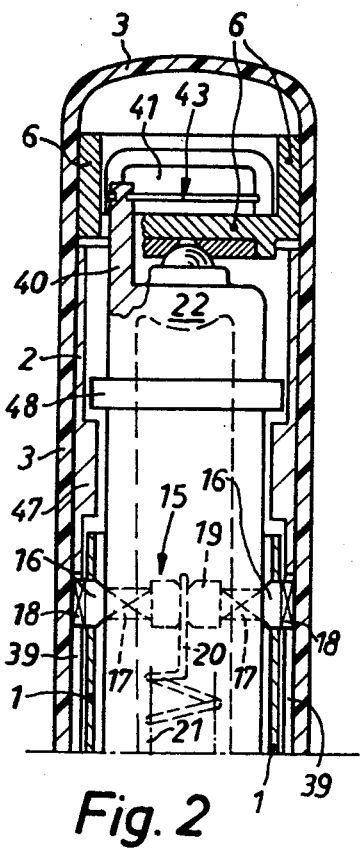
Fig. 2
Fig. 3
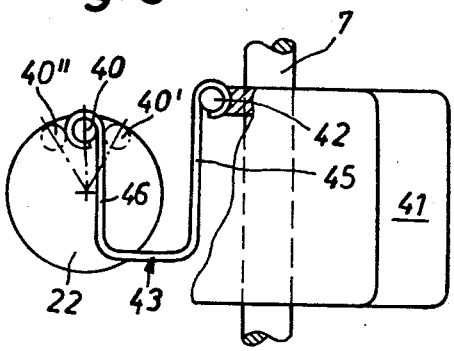

Fig. 4
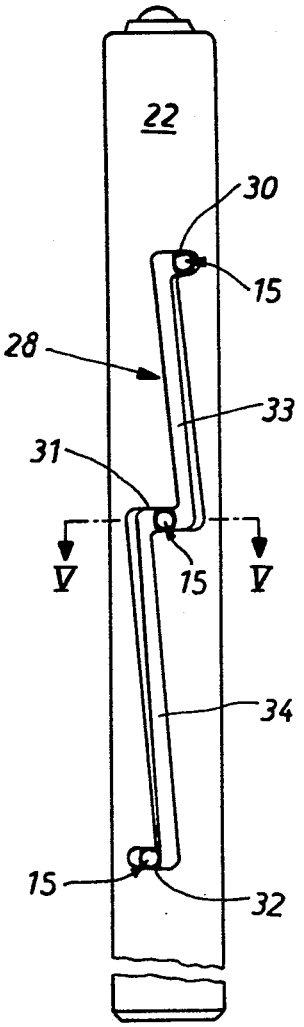
Fig. 6
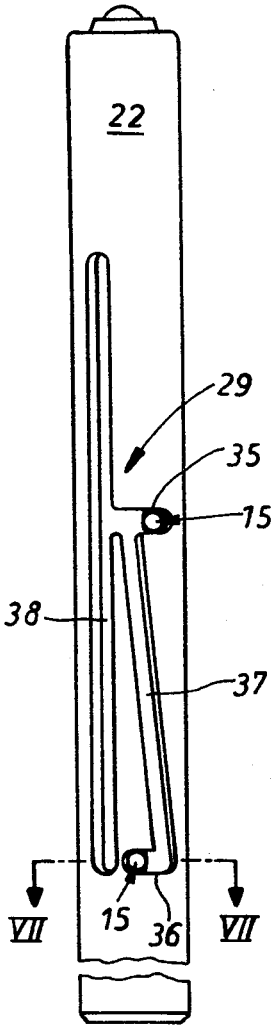
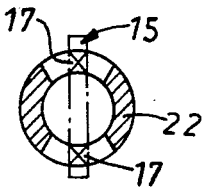
Fig. 5
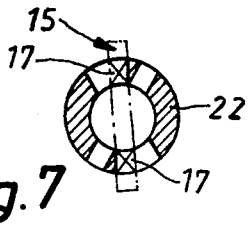
Fig. 7

LONGITUDINALLY ADJUSTABLE SKI POLE

BACKGROUND OF THE INVENTION

1. Field of the Invention

The present invention relates to an improved ski pole having an adjustable length, which said ski pole is provided with two telescopically movable tube sections which are inserted into each other and are arrestable at their respective positions by an arresting means, which said ski pole is provided further with an operating member located at the handle portion of said ski pole and operationable for a mutual arresting or unlatching of both said tube sections, which said operating member is arranged to be reachable by the fingers of the skier's hand gripping the ski pole, which arresting means comprises a latching arrangement having a plurality of catches, and whereby there is provided a spring which engages at the one end the inner tube section and at the other end the outer tube section, which said spring biasses both said tube sections away from each other.

Such a ski pole can be used on the one hand as a rigid ski pole having an adjustable length and on the other hand as a spring elastic ski pole yielding elastically in its longitudinal direction. Such features are specifically of interest for cross-country skiers because at the one hand the length of the ski pole may be adjustable in accordance with the prevailing shape of the country and at the other hand the spring force which is stored in the ski pole may be used as thrusting aid.

2. Description of the Prior Art

Such a ski pole is disclosed in the NO-PS 73 712. The latch of this known ski pole (see FIG. 4) comprises three elastically and radially spreadable tongues, which are operated by the operating member by the agency of an axial bar. The catches are formed by circumferential grooves. The operating member is shaped as a push button. If the push button is not operated, both tube sections are locked or arrested, respectively, against each other whereby a rigid ski pole having the respective chosen length is present. When the push button is pressed, the tube sections are unlatched and an elastically yielding ski pole is achieved. The drawback of this ski pole is that when using such ski pole as elastically yielding ski pole in order to utilize the stored spring force as thrust aid, the push button must continuously be pressed down. A further drawback of this known ski pole is that during the adjustment of the longitudinal extent of the rigid ski pole the latch cannot positively snap and lock into predetermined, for instance, two or three catches when the ski pole has attained a sought length during the skiing, i.e. when engaging the ground.

SUMMARY OF THE INVENTION

It is an object of the present invention to provide a ski pole which allows an adjustment of its elastically yielding condition to a rigid condition and vice versa and which further allows an increase or decrease of its length during the skiing proper and without any detrimental influence of the skier's rhythm.

A further object of the invention is to provide a ski pole which comprises a pivoting cylinder at which the catches are provided, which said pivoting cylinder is provided with a groove whereby said catches form a part of said grove, which said pivoting cylinder is pivotably supported in said inner tube section and operationally connected to the operating member.

BRIEF DESCRIPTION OF THE DRAWINGS

The present invention will be more fully understood by reference to the following detailed description thereof when read in conjunction with the attached drawings, and wherein:

FIG. 1 is a view of a longitudinal section through the upper portion of a ski pole encompassing roughly the ski pole grip and shown on an increased scale;

FIG. 2 is a view of the longitudinal section of the upper portion of the ski pole grip designed relative to FIG. 1 at a 90° rotated position;

FIG. 3 is a top view on a detail of the FIGS. 1 and 2;

FIG. 4 is a detail of FIGS. 1 and 2 on a decreased scale relative to these two figures and which is a view of a first preferred embodiment of the ski pole;

FIG. 5 is a view of a section along line V—V of FIG. 4;

FIG. 6 is a view similar to the view of FIG. 4 of a second preferred embodiment of the ski pole; and FIG. 7 is a view of a section along the line VII—VII of FIG. 6.

DETAILED DESCRIPTION OF THE PREFERRED EMBODIMENT

Describing now the drawings and considering initially the exemplary embodiment of the ski pole as shown in FIG. 1 it will be understood that same comprises an inner tube section 1 which carries at its lower end (not particularly shown) the well-known snow ring as well as the ski pole point. Furthermore, there is provided an outer tube section 2 extending roughly along the length of the ski pole grip. This ski pole grip or grip section, respectively, of the ski pole comprises a shell 3 made of a plastic material, which shell 3 in the practice is a multi-part design whereby, however, the shell 3 is shown in FIGS. 1 and 2 for sake of clearness as an integral one-part design. This plastic shell section 3 is covered at least at cross-country ski poles partly by deerskin or buckskin which is not particularly shown in the drawings. A bearing cap 4 having an outer shape in accordance with line curve 5 is located on the outer tube section 2. This bearing cap 4 comprises surfaces of sections 6 in accordance with FIGS. 1 and 2. In the top view of the ski pole according to FIG. 1 the bearing cap 4 is a U-shaped design whereby both free ends of its legs are located at the right hand side of the drawing. These two legs are provided each with a bearing bore for the receipt of a journal pin 7. In the practice the bearing cap 4 is made of a plastics material and this bearing cap is pressed into a bearing plate made of steel. The bearing cap 4 is provided with three detent grooves 9. The bearing shell 3 supports a sealing ring 10 arranged in one circumferentially extending groove.

At the lower end of the ski pole grip there is arranged a clamping eccentric 11 which is supported in a clamping collar 12. The screw bolt arrangement which tightens the clamping collar 12 acts simultaneously as a support of the clamping eccentric 11. It has been mentioned further above that the shell 3 of the ski pole grip is covered by deerskin or buckskin. Such deerskin or buckskin may be pressed by the agency of the clamping collar 12 against the shell 3 of the grip such that a clean and safe closing off of the deerskin cover at the bottom end may be secured. The clamping eccentric 11 acts as support and mounting member of the two ends 13 and 14 of the well-known ski pole strap which is not particularly shown in the figures. All ski poles are provided with said strap extending in the form of a loop beginning and terminating adjacent the upper end of such ski pole.

Below the arresting arrangement of the ski pole is explained with which the two tube sections 1 and 2 which may be moved into each other can be arrested or locked, respectively, in a given position relative to each other whereby such locking may be unlatched whenever needed. The inner tube section 1 carrying the snow ring as well as the ski pole point comprises two through bores located diametrically opposite from each other in which through bores a rod or bar shaped latch 15 is mounted at its end sections 16 (FIG. 2). This rod or bar 15 comprises two sections 17 which are provided with planar surface areas because these sections 17 act as sliding blocks which will be explained in detail further below. The rod comprises, furthermore, two end sections 18 which are suitably provided also with two guiding surfaces arranged oppositely relative to each other. The rod 15 comprises, furthermore, a center section 19, in which the one end 20 of a spiral tension spring 21 engages. Accordingly, the rod 15 is supported in the inner tube section 1 in an axially unmovable position and also is held against rotation. As already mentioned, this bar 15 serves also as latch of the arresting or latching means whereby the two sliding blocks 17 cause the latching proper which will be explained further below.

This rod or bar 15, respectively, is arranged within a pivoting cylinder 22 which carries at its upper end a bearing ball 23 and at its lower end a bearing plate 24 made of a metal and arranged in a press fit. The pivoting cylinder 22 is preferably made from a plastics material. A ball 25 is arranged in mentioned bearing plate 24, which ball 25 is embedded in a guide sleeve 26. This guide sleeve 26 is rotatably and longitudinally movable seated in the inner tube section 1. The lower end 27 of the spring 21 engages the guide sleeve 26. By the agency of a pretensioning, also in the position as shown in FIG. 1, the spiral tension spring 21 urges the guide sleeve 26 and the pivoting cylinder 22 together above and over the bearing ball 23 against the bearing cap 4 because the fixed support of the end 20 of the spring 21 is located at the inner tube section 1. The pivoting cylinder 22 is a hollow construction and comprises the catches of mentioned arresting arrangement. The pivoting cylinder 22 is provided with a groove 28 or 29 such as shown in FIGS. 4 and 6. The groove 28 or 29 penetrates completely the hollow pivoting cylinder 22 such that the groove opens at both diametrically opposed surfaces of the jacket of the pivoting cylinder (FIGS. 5, 7). The groove 28 shown in FIG. 4 comprises two Z-shaped groove sections which follow each other immediately with regard to the longitudinal extent of the pivoting cylinder 22 such that three catches 30, 31 and 32 are defined. The catches 30-32 are accordingly part of the groove 28. Between mentioned catches 30, 31 and 32 the respective center sections 33 and 34 of the Z-shape consisting of three sections 30, 31, 33 or 31, 32, 34, respectively, are located. These center sections 33 and 34 extend obliquely relative to the longitudinal axis of the pivoting cylinder 22. Out of the embodiment of the pivoting cylinder 22 drawn in FIG. 6 it can be seen that here again a Z-shaped groove section is provided with catches 35 and 36 as well as a center section 37. The embodiment of the pivoting cylinder 22 in accordance with FIG. 6 comprises in addition a rectilinear groove section 38 which extends parallel to the longitudinal axis of the pivoting cylinder 22. The bar or rod, respectively, shaped latch 15 is guided by the agency of its two sliding blocks 17 in the groove 28 or 29 which penetrates completely the pivoting cylinder 22.

Both ends 18 of the rod shaped latch 15 are guided in elongated slots 39 of the outer tube section 9 whereby these elongated slots 39 extend parallel to the longitudinal axis of the pivoting cylinder 22. Because the pivoting cylinder 22 extends coaxially to both tube sections 1 and 2, these elongated slots 39 extend also parallel to the longitudinal axis of the tube sections 1 and 2. Due to the fact, that the latch 15 is supported in the inner tube section 1 and due to the fact that it is guided in the outer tube section 2, the two tube sections 1 and 2 cannot be rotated relative to each other but may be axially moved relative to each other. The pivoting cylinder 22 is rotatable relative to both tube sections 1 and 2 around a limited angle of rotation. The pivoting cylinder 22 is provided with an offset pivot point 40 which is defined by a plug which is arranged outside of the longitudinal axis of the pivoting cylinder 22. An influence of a force acting laterally to the plug 40 generates a rotation of the pivoting cylinder 22 along a limited angle of rotation, i.e. the pivoting cylinder 22 will be pivoted.

An operating member 41 is pivotably supported on the journal pin 7 of the bearing cap 4. This operating member 41 is constructed in the shape of a double armed pivoting or tilting arm. One arm section of the operating member 41 is provided with a pivot point 42 for a linkage 43. The other arm section of the operating member 41 comprises a wart like projection 42 which acts together with the detent grooves 9 and shapes a snap like locking arrangement therewith. The shown embodiment comprises three detent grooves 9 such that the operating member 41 can successfully snap by means of its wart like projection 44 into mentioned three detent grooves 9 such that three predetermined positions of the operating member 41 are defined. In FIG. 1 one such position of the operating member 41 is shown. In the other two possible positions of the operating member 41 the pivot point 42 is located at the positions 42' or 42'' of the drawing. The operating member 41 is operationally connected by the agency of a linkage 43 with the pivoting cylinder 22. This linkage 43 is shaped as a U-shaped leaf spring whereby one of the free legs 45 of the leaf spring engages the operating member 41 and the other leg 46 of the leaf spring engages the off-center pivot point 40 of the pivoting cylinder 22 (FIG. 3). The various positions of the respective elements operationally connected to each other, namely the elements 41, 43, 40 and 22 are shown in FIGS. 1 and 3. In the position of FIG. 3 the pivot point 42 is in the position 42' shown in FIG. 1. In FIG. 3 there is shown that the plug 40 can be located beside the designed center position in two further positions 40' and 40''. The operating member 41 is shown in FIG. 1 in a downwardly tilted position and accordingly the plug shown in FIG. 3 would be located in the position 40'. If the operating member 41 of FIG. 1 would be located in its center or intermediate, respectively, position such that the pivot point 42 is at the location 42', the plug 40 would be located at the position shown in FIG. 3. If the operating member 41 shown in FIG. 1 would be pressed at its upper end inwardly such that the pivot point 42 would be located at the position 42'', the plug in FIG. 3 would be located in a position 40''.

As shown clearly in FIG. 1, the operating member 41 is located at a position opposite of the position of the ends of the straps 13, 14 relative to the gripping portion of the ski pole. Because these strap sections 13 and 14 face the skier, the operating member 41 accordingly is located at the reverse side of the ski pole grip. As shown in FIG. 1, the operating member 41 projects a fixed portion of the ski pole grip, namely initially mentioned grip shell 3. The operating member 41 is arranged in the upper section of the ski pole grip such that the operating member 41 may be engaged by the index finger of a hand of a skier gripping the ski pole properly.

Below, the operation of the above described ski pole will now be described. It shall be assumed that the pivoting cylinder 22 shown in FIGS. 1 and 2 comprises the groove 28 shown in FIGS. 4 and 5. Accordingly, this groove 28 comprises three catches 30, 31 and 32. In FIG. 1 catch 30 and the center section 33 of the groove 28 is designed. The ski pole may be adjusted to have three distinct lengths whereby when the ski pole is in a position having a shortest length, latch 15 is located in the catch 30 shown in FIGS. 1, 2 and 4. In this shortest ski length the spiral tension spring 21 is in its strongest tensioned position, i.e. this spring is in the position of its largest length. If the ski pole is adjusted to its shortest length, the outer tube section 2 carrying the ski pole grip is moved to the largest possible extent over the inner tube section 1. Considering the drawing of FIG. 1 the outer tube section 2 is accordingly in its lowest position relative to the inner tube section 1. The operating member 41 is pushed inwards at its lower end. If now the ski pole shall be adjusted such that it is in its intermediate, respectively, length, the operating member 41 is operated into its middle position. Accordingly, the pivoting cylinder 22 is rotated somewhat such that the plug 40 of FIG. 1 comes to lie on the longitudinal axis of the pivoting cylinder 22 such as shown in FIG. 3. This rotating of the pivoting cylinder 22 causes the latch 15 to leave the horizontal section 30 (catch) and it is now located in the middle or center, respectively, section 33 of the coulisse. Now the tension spring 21 can operate, it decreases its length somewhat such that according to FIG. 1 the pivoting cylinder 22 is moved upwards together with all elements mounted or connected, respectively, thereto, accordingly, also together with the ski pole grip, which movement proceeds upwards relative to the inner tube section 1, which movement proceeds until the latch 15 snaps into the catch 31 shown in FIG. 4. This snapping of the latch 15 into the catch 31 is achieved by the extent of the center portion 33 of the groove 28 shown in FIG. 4. It has been mentioned earlier that this center portion 33 extends obliquely relative to the longitudinal axis of the pivoting cylinder 22. This means, that the pivoting cylinder 22 has been rotated somewhat against the force of the spring 43 whereby the leg 46 of the leaf spring has been pressed or urged, respectively, somewhat against the corresponding leg 45. If now the center section 33 of the groove 28 moves into the catch 31, the previously deformed spring 43 may bend back again such that latch 15 can snap into the catch 31. Now, the ski pole has been brought into its intermediate length. If the ski pole is to be extended to its largest length, the operating member 41 is pressed inwards at its upper end. Accordingly, the pivoting cylinder 22 is rotated further such that the plug 40 in accordance with the design of FIG. 3 is located at the position 40". By this movement the catch 31 is adjusted relative to the latch 15 such that the latter arrives at the center section 34 of the coulisse 28 in accordance with FIG. 4. The spring 21 relaxes further whereby the pivoting cylinder 22 is moved together with the outer tube section 2 and the ski pole grip in accordance with FIG. 1 upwards. Again, due to the extent of the center section 34 of the groove 28, namely obliquely to the longitudinal axis of the pivoting cylinder 22, spring 43 is tensioned again. As soon as catch 32 is reached, spring 43 can relax again such that latch 15 snaps into catch 32 in accordance with FIG. 4. The ski pole has now been brought into its longest position. The spiral tension spring 21 is now maximally relaxed, is however still in a pretensioned position. The shortening of the ski pole proceeds as follows:

If the skier, specifically the cross-country skier, wishes to shorten the ski pole, the latch 15 located in catch 32 at the pivoting cylinder 22 including the groove 28 in accordance with FIG. 4 is to be moved into catch 31. The catch 31 of the three catches of FIG. 4 and accordingly, three possible ski pole lengths relates to the intermediate ski pole length. This desired length of the pole is pre-chosen by the cross-country skier during the skiing by pressing the operating member 41 in its intermediate position. Thereby, the pivot point 42 is in position 42'. The spring 43 according to FIG. 3 will be pretensioned thereby, this because leg 45 of the spring is moved against or towards, respectively, leg 46 thereof. This intermediate position of the operating member 41 is determined by a snapping in of the projection 44 into the center catch. Now the intermediate ski pole length is pre-chosen. The shortening of the ski pole proceeds now simultaneously with the first placing or setting, respectively, of the ski pole carried out by the skier. Thereby the tension spring 21 is tensioned further and due to the extent of the center portion 34 of the groove obliquely to the vertical line spring 43 is tensioned such that also the lateral walls of the section 34 of the coulisse is pressed against the sliding blocks 17 of the latch 15. As soon as catch 31 has reached the height of catch 15, the pivoting cylinder 22 is snap-like rotated somewhat due to the pretension of leaf spring 43 such that catch 31 comes to engage latch 15. Now the ski pole is in its intermediate length, for instance, its normal length. If now the cross-country skier wishes to shorten the ski pole to its shortest length, he must press the operating member 41 at its upper end section inwards such that in accordance with FIG. 1 the pivot point 42 is moved into position 42". This leads again to a pretensioning of leaf spring 43 shown in FIG. 3, the off-center plug 40 remains initially in the position shown in FIG. 3 by the uninterrupted lines until the placing of the pole is carried out. Thereby, the inner tube section 1 is supported or pressed, respectively, via the ski pole point or the snow ring on or against the ground such that accordingly latch 15 is also pressed against the ground via the inner tube section 1 and the ski pole grip can be moved downwards together with the outer tube section 2 and the pivoting cylinder 22 until the catch 30 arrives at the level of latch 15 such that again the pivoting cylinder 22 is rotated somewhat and such that the catch 30 comes to engage latch 15.

For sake of clarity the pivoting cylinder 22 is shown in FIG. 4 in an unmovable position and only the latch 15 is drawn in its three different level heights. Practically, however, the height of the level of latch 15 remains unchanged and pivoting cylinder 22 will get located relative to latch 15 at three varying height levels. In FIG. 5 it is shown that both sliding blocks 17 of latch 15 are located in catch 31.

The embodiment of the pivoting cylinder 22 in accordance with FIG. 6 comprises in addition to the shape in accordance with the invention, namely in addition to latch and several catches, a rectilinearly extending groove section 38. The catches 35 and 36 allow again an adjustment such to have two ski pole lengths, in comparison with FIG. 4 to have an intermediate ski pole length and an enlarged ski pole length. When catch 35 engages latch 15, the ski pole is in its normal length and if catch 36 engages latch 15, the ski pole is in its largest, i.e. in its larger length. If the pivoting cylinder 22 in accordance with FIG. 6 is used together with the ski pole grip shown in FIG. 1 and if the operating member 41 is pressed inwards at its lower end in accordance with FIG. 1, the shortest ski pole length is chosen such that the catch 35 engages latch 15 or will come to engage latch 15. If the operating member 41 is brought into its intermediate position, in which position the pivot point 42 is at location 42', the ski pole is adjusted into its normal length, i.e. in this case it has been elongated and if the operating member 41 has been pressed inwards at its upper end, the pivoting cylinder 22 in accordance with FIG. 6 is rotated such that its vertically extending catch section 38 is aligned with latch 15. If now the ski pole is placed or set upon the ground, the outer tube section 2 will be pushed over the inner tube section 1 until the upper end of the groove section 31 abuts latch 15. Now the spiral tension spring 21 is in the position, in which its tension is the greatest. If now the cross-country skier does no longer exert by his hand a force onto the ski pole, spring 21 supported via the ski pole point on the ground can release and accordingly, urges or pushes, respectively, the ski pole grip and the hand of the cross-country skier upwards. Accordingly, a thrusting movement relative to the ground is achieved. By placing the ski pole the cross-country skier has supported himself via spring 21 on the ground and now the force of the spring acts back onto the hand of the cross-country skier. Accordingly, an elastically yielding ski pole is achieved. In the relaxed spring position the lower end of the groove section 38 in accordance with FIG. 6 abuts or engages, respectively, latch 15.

The outer tube section 2 is provided with projections 47, and the pivoting cylinder 22 is provided with shoulders 48 such that the various elements of the ski pole assembled in accordance with FIGS. 1 and 2 are held together after assembly.

As can be seen in FIG. 6, the rectilinear groove section 38 is reached from the short position of the ski pole (catch 35 engaging latch 15). This means that catch 35 is connected to the groove section 38. According to a further embodiment the groove shown in FIG. 6 could be changed such that the catch 36 of the groove can be connected to section 38 of the groove and that catch 35 is not in connection with section 38 of the coulisse. In such an embodiment the elastically yielding ski pole (section 38 of the coulisse aligned with latch 15) is arrived from the longest position of the ski pole.

It is obvious that the embodiment of the inventive ski pole in accordance with claim 1 can be arrived at by various structural designs. The shown embodiment is specifically preferred because only a few and simple structural elements are necessary, which structurally may be designed to have a light weight such that a ski pole equipped therewith is only a little heavier than a common ski pole which is not longitudinally adjustable. Accordingly, a great many structural elements may be made from a plastic material having an as low as possible specific gravity. Furthermore, the few structural elements used are utilized for several objects. For instance, latch 15 operates in addition to its latching function also has a rotational arrest of both tube sections 1 and 2, acts further as supporting member for spring 21 and, still further, as guide for the axially movable ski pole grip.

The operating member of the ski pole is the same respectively for the left and the right ski pole. Both operating members on both ski poles will accordingly be pressed at the upper or the lower end or brought into their intermediate position such that no differing operational directions depending on the left or the right pole must be obeyed. The operation of the ski pole has a logic basis. If both operational members of the ski poles are in their intermediate position, the ski poles are adjusted to their normal length, i.e. such length which the cross-country skier uses at a normal ski pole which has no adjustable length. If the operating members are pressed down, the ski poles will be adjusted to their shorter length. If the operating members are pressed upwardly, the ski poles will be adjusted to their largest length or, when the pivoting cylinder of FIG. 6 is used, the ski poles are brought into their elastically yielding position.

The order for adjusting the pole given by the finger of the cross-country skier can be exerted at any time during skiing, i.e. in every position of the ski pole, for instance, when the cross-country skier pulls the pole forwardly. If now the cross-country skier gives in this instance the order for an elongation of the pole (operating member 41 is pushed inwards at its upper end), the cross-country skier carries out a pre-switching because the shortening of the ski pole takes place during the following placing or setting, respectively, of the pole on the ground.

All chosen adjustments of the ski pole are displayed by the position of the operating member 41 relative to the rest of the ski pole grip and, additionally, can be felt by the finger of the cross-country skier during skiing.

The extent of the section 33, 34 and 37 of the groove in accordance with FIGS. 4 and 6 directed obliquely to the vertical leads to two facts. As already mentioned, the pivoting cylinder 22 will be rotated somewhat by a simultaneous deformation of spring 43 when adjusting the length of the ski pole such that then the pivoting cylinder engages snap-like with one catch latch 15. If on the other hand an elongation of the ski pole is carried out and whereby the spring 21 relaxes such procedure is no sudden procedure, it is rather dampened somewhat against the force of spring 43. The oblique extent of the sections 33, 34 and 37 of the groove follow in that the latching position is arrived by the influence of the spring force and accordingly, with a snap-like action such that accordingly, in accordance with FIG. 4 the intermediate catch 31 cannot be overridden when increasing or decreasing the length of the ski pole. Furthermore, the increase of the length of the ski pole proceeds softly and not suddenly. This is of advantage for the hand of the cross-country skier. The various structural elements are also protected from excessive wear.

If the pivoting cylinder 22 including groove 28 is used in accordance with FIG. 4 and if the ski pole is in its normal length whereby accordingly the catch 31 engages latch 15, it has been proven in practice that it is specifically advantageous when the ski pole is designed such that the increase of length from the intermediate position amounts to 40 mm and the decrease of length relative to the intermediate position amounts to 30 mm. When carrying out such an elongation of 40 mm, catch 32 engages latch 15. When decreasing the length of the pole by mentioned 30 mm, catch 30 will engage latch 15. When using the pivoting cylinder in accordance with FIG. 6, the length of the ski pole can be increased by 40 mm relative to its normal length, whereby in such case catch 36 engages latch 15. If the ski pole is in its free elastically yielding position, i.e. if the vertically extending section 38 of the groove is aligned with latch 15, the ski pole will be elastically shortened or stretched by an amount of 70 mm.

If the ski pole is used with the pivoting cylinder 22 in accordance with FIG. 4, a weaker spring 21 is used in comparison when having the pivoting cylinder of FIG. 6, because in the first case spring 21 is basically only needed for an automatic elongation of the ski pole such that the two tube sections 1 and 2 cannot be pulled away from each other by hand. It has shown in a practical application that in such case spring 21 can be designed such that this spring 21 can be brought by application of a force from 2 kg from its shortest mounting length to its longest mounting length. If in contrast thereto the pivoting cylinder of FIG. 6 is used, spring 21 is used for a forceful thrusting of the ski pole. In practice it has been seen that in such case spring 21 must be designed that strong, that in order to stretch the spring from its shortest mounting length to its longest mounting length, a force up to 15 kg should be necessary.

The support or mounting, respectively, of the strap portions 13 and 14 of the loop of the ski pole by the agency of an eccentric 11 is extremely advantageous, which mounting is shown in FIG. 1. It is possible hereby to adjust the length of the loop ideally. The skier inserts his hand into the loop and grips the ski pole grip. With the other hand the skier grips the free ends of the straps 13 and 14 extending from the eccentric 11 downwards and pulls these ends of the straps away from the inner tube section 1 such that the strap ends will pivot arm 49 of the eccentric 11 and the clamping action is released. Now the ends of the straps may be pulled as far down as necessary until the length of the section of the loop surrounding the hand or the wrist, respectively, of the skier has reached the desired length. Thereafter the skier pushes by using his free hand the arm 49 against the inner tube section 1 such that the strap ends 13 and 14 of the loop are clamped at the outer tube section 2. This described adjustment of the loop of the ski pole can accordingly be carried out extremely easily whereby it is not necessary to take the gloves or mittens, respectively, off.

While there are shown and described present preferred embodiments of the invention, it is to be distinctly understood that the invention is not limited thereto, but may be otherwise variously embodied and practiced within the scope of the following claims. ACCORDINGLY,

What is claimed is:

1. An improved ski pole having an adjustable length, which said ski pole is provided with two telescopically movable tube sections which are inserted into each other and are arrestable at their respective positions by an arresting means, which said ski pole is provided further with an operating member located at a handle portion of said ski pole and operational for mutual arresting or unlatching of both said tube sections, which said operating member is arranged to be reachable by the finders of the skier's hand gripping said ski pole, which arresting means comprises a latching arrangement having a plurality of catches and whereby there is provided a spring which engages at the one end the inner tube section and at the other end the outer tube section, which said spring biasses both said tube sections away from each other, the improvement comprising a pivoting cylinder at which said catches are provided, which said pivoting cylinder is provided with a groove where said catches form a part of said groove, which said pivoting cylinder is pivotably supported in said inner tube section and operationally connected to said operating member.

2. The ski pole of claim 1, wherein said latching arrangement is arranged at said inner tube section and said catches are arranged at said pivoting cylinder, further wherein said catches are located consecutively longitudinally of said outer tube section, and wherein said catches are operationally connected to said operating member whereby one of said catches may be caused to engage or disengage from said latching member.

3. The ski pole of claim 1, wherein said pivoting cylinder comprises an off-center pivot point for a linkage which engages at its opposite end into said operating member, which said operating member is a rocker arm.

4. The ski pole of claim 3, wherein said linkage is pivotably mounted to one arm section of said operating member, further wherein the other arm section of said operating member defines together with an unmovable section of the outer of said tube sections a snap-like operating arresting means.

5. The ski pole of claim 1, wherein said groove comprises at least one z-shaped groove section, which consists of three parts, whereby its center part extends obliquely to the longitudinal axis of said pivoting cylinder.

6. The ski pole of claim 5, wherein said groove comprises two Z-shaped groove sections located directly adjacent relative seen in the longitudinally direction of said pivoting cylinder whereby three catches are defined.

7. The ski pole of claim 1, wherein further there if provided a rectilinear groove section adjacent one Z-shaped groove section and which rectilinear groove section extends parallel to the longitudinal axis of said pivoting cylinder.

8. The ski pole of claim 1, wherein said latch is a bar shaped member having at least one sliding block which is guided in said groove of said pivoting cylinder, further wherein said bar is supported at both its end sections in diametrically oppositely located wall sections of said inner tube section.

9. The ski pole of claim 1, wherein said groove penetrates completely said pivoting cylinder such that said groove opens at both diametrically oppositely located sides of the jacket surface of said pivoting cylinder.

10. The ski pole of claim 1, wherein said pivoting cylinder is a hollow construction, further wherein said spring is a spiral tension spring engaging at the one end said pivoting cylinder and at the other end said latching arrangement, and wherein said spring is located inside of said pivoting cylinder.

11. The ski pole of claim 8, wherein said bar is guided at both its ends in longitudinal slots arranged in said outer tube section, which said slots extend parallel to the longitudinal axis of said pivoting cylinder.

12. The ski pole of claim 3, wherein said linkage is formed by a U-shaped leaf spring, further wherein the one free leg of said leaf spring engages said operating member and the other free leg of said leaf spring engages the off-center pivot point of said pivoting cylinder.

13. The ski pole of claim 4, wherein at the tilting movement of said operating member said operating member may snap into three catch grooves of the unmovable section by means of a projection.

* * * * *